United States Patent [19]

Büechel

[11] Patent Number: 4,708,061

[45] Date of Patent: Nov. 24, 1987

[54] EXPLOSIVE POWDER CHARGE OPERATED DRIVING DEVICE

[75] Inventor: Franz Büechel, Ruggel/Liechtensteiner, Liechtenstein

[73] Assignee: Hilti Aktiengesellschaft, Fürstentum, Liechtenstein

[21] Appl. No.: 16,655

[22] Filed: Feb. 19, 1987

[30] Foreign Application Priority Data

Feb. 22, 1986 [DE] Fed. Rep. of Germany ..... 3605832

[51] Int. Cl.[4] ..... F42B 13/44

[52] U.S. Cl. ..... 102/331; 102/333; 42/70.11; 42/75.01

[58] Field of Search ..... 42/70.11, 70.01, 75.01, 42/76.01, 1.14; 102/314, 331, 332, 333, 464

[56] References Cited

U.S. PATENT DOCUMENTS

| | | | |
|---|---|---|---|
| 3,882,780 | 5/1975 | Gawlick et al. | 102/483 |
| 3,951,038 | 4/1976 | Van Langenhoven | 102/702 X |
| 3,952,658 | 4/1976 | Broyles | 102/438 |
| 4,335,657 | 6/1982 | Bains | 102/433 |
| 4,406,079 | 9/1983 | Buechel et al. | 102/281 X |
| 4,651,454 | 3/1987 | Harris | 102/430 X |

FOREIGN PATENT DOCUMENTS 0553037 10/1972 Switzerland .

*Primary Examiner*—Peter A. Nelson

*Attorney, Agent, or Firm*—Toren, McGeady & Associates

[57] ABSTRACT

An explosive powder charge operated tool for driving fastening elements into a receiving material has a locking member supported in the housing for effecting the return movement of the driving member located within the barrel. The locking member has a radially inwardly directed nose located in the path of an annular shoulder on the driving member. A retaining member with a support shoulder holds the locking member in position within the housing. The retaining member and shoulder are rotatable about the housing for aligning an aperture in the shoulder with the locking member so that the locking member can be removed without the use of any auxiliary tools.

5 Claims, 2 Drawing Figures

EXPLOSIVE POWDER CHARGE OPERATED DRIVING DEVICE

BACKGROUND OF THE INVENTION

The present invention is directed to an explosive powder charge operated driving device for driving fastening elements and the like into a receiving material. The device includes a housing with a driving piston located within the housing and having a radially extending shoulder at the rear end of the shank part of the driving piston with the shoulder facing in the driving direction. The driving piston is located within a barrel which is displaceable relative to the housing in the driving direction of the piston. A locking member is mounted on the housing and extends into the path of the shoulder on the driving piston. The part of the locking member which engages the shoulder extends perpendicular to the axis of the driving member. A retaining member mounted on the housing includes a support shoulder for retaining the locking member within the housing. At least a portion of the support shoulder overlaps the locking member when it is positioned within the housing.

In explosive powder charge operated driving tools including a driving piston for transmitting the explosive force of the charge to a fastening element to be installed, the driving piston after a fastening element has been driven into a receiving material, must be displaced rearwardly within the barrel into a position ready to drive another fastening element.

In a known driving device disclosed in CH-PS No. 533,037, a locking member is positioned in the housing of the driving device and is provided for moving the piston member in the axial direction opposite to the driving direction by contacting a radially extending shoulder on the piston. After a fastening element has been driven, by moving the barrel in the driving direction with the locking member bearing against the shoulder on the driving piston, the piston is displaced to the rear end of the barrel so that it can be moved rearwardly with the barrel into the ignition position.

The locking member is retained in the operating position by a support shoulder of a retaining member forming a part of the tool housing. To replace the driving piston, the locking member must be removable and this is effected by removing the retaining member which is in the form of a screw. The removal of the retaining member requires an auxiliary tool and, in addition, requires considerable manipulative effort due to the need to completely remove the retaining member. Similarly, additional effort is needed for the insertion and retention of the locking member by the retaining member.

SUMMARY OF THE INVENTION

Therefore, it is the primary object of the present invention to provide a driving device in which the removal and replacement of the locking member can be effected without any auxiliary tools and without any appreciable manual effort, with the locking member in its engaged position serving for effecting the return stroke of the driving piston.

In accordance with the present invention, a retaining member, rotatable about the axis of the driving piston, has a support shoulder extending along at least a portion of the circumferential direction of the retaining member.

Due to the rotatability of the retaining member, around the axis of the driving piston, where the retaining member is an annular member, it can be moved into different positions with a portion serving as a support shoulder so that it can overlap the locking member or can be moved into a position where it does not overlap the locking member. The retaining member can be rotated without requiring any auxiliary tools. The retaining member can be located in the different rotational positions by a frictional lock.

Preferably, the retaining member is an annular member extending around the housing with a portion of its inner surface forming a support shoulder interrupted by an aperture corresponding at least to the radial projection of the overlapped locking member. An annular retaining member does not require any special guide means, since its ring-shaped configuration embraces the housing in a self-retaining manner. Accordingly, it is necessary only to axially fix the ring with respect to the housing.

For the insertion or removal of the locking member, the annular retaining member is rotated until the aperture formed in its support shoulder is aligned or in register with the locking member or a recess for the locking member within the housing. The locking member can have a beam-like shape so that one end extends into the housing, while the other end is secured by the overlapping engagement of the support shoulder on the retaining member with the locking member.

With a spring element acting on the locking member, automatic disengagement can be effected, when the aperture in the retaining member is aligned with the locking member. To assure that the retaining position of the retaining member is maintained under vibration of the driving device during use, a locking element is provided for securing the retaining member against rotation. Appropriately, the locking element is formed by snap-in members, such as balls, cams or the like, which seat under spring force into corresponding snap-in depressions.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
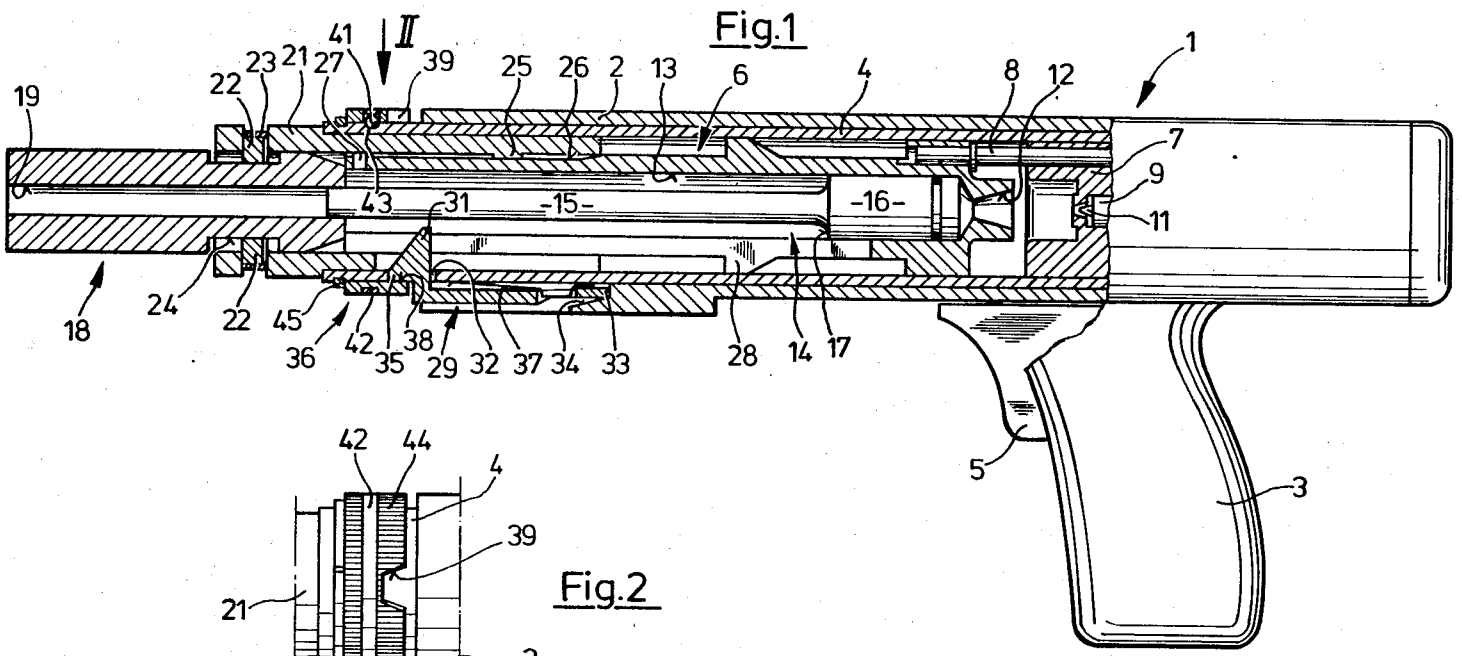
FIG. 1 is a elevational view of a driving device, partly in cross-section, in a neutral position with the driving piston in a retracted position.

In FIG. 1, a device for driving fastening elements into a receiving material is shown and includes a housing 1 elongated in the driving direction. The housing 1 and a number of the parts of the device have a front end located to the left and a rear end located to the right as viewed in FIG. 1. The driving direction is in the leftward direction toward the front end of the housing. Housing 1 includes an outer shell 2 with a handle 3 extending downwardly from the rear end of the outer shell. A tubular shaped chuck body 4 is fixed within the shell 2 and projects in the driving direction, outwardly from the front end of the shell. A trigger 5 is located in the handle 3 and can be actuated for initiating the firing of an explosive powder charge for driving a fastening element. The firing mechanism, which is well known, is not shown in detail.

A guide bushing or barrel 6 is displaceably supported within the chuck body 4. If the front end of the driving device is pressed against a receiving material, the barrel is displaced in the rearward direction opposite to the firing direction, towards a breach member 7 fixed in the rear part of the housing. With the barrel 6 displaced rearwardly, it is in position ready to fire an explosive charge. The rearward displacement of the barrel 6 occurs against a spring or biasing force over a cocking pin 8 seated in the barrel 6, and acting against a spring in the firing mechanism located in the rear part of the housing, the spring is not illustrated. The firing mechanism includes a firing pin 9, displaceably supported within the breach member 7, so that a firing nose or point 11 can be driven forwardly, that is, in the firing direction for igniting an explosive powder charge. At its rearward end, the barrel has a conically-shaped bore or cartridge chamber in axial alignment with the nose 11 on the firing pin 9. The bore or firing chamber 12 converges inwardly in the driving direction and terminates at the rear end of a central bore 13 within the barrel 6 with a driving piston 14 supported within the bore. The driving piston 14 is an axially elongated member extending in the driving direction and made up of an axially elongated shank 15 spaced inwardly from the surface of the bore 13 and a rear piston head 16 in sliding engagement with the bore 13. The head 16 projects radially outwardly from the shank 15 forming an annular shoulder 17, facing in the driving direction. As viewed in FIG. 1, the front end of the shank 15 is in sliding engagement with a muzzle bore 19 formed in a muzzle part 18 with the bore located in axial alignment with the barrel 6 and the driving piston 14. Muzzle part 18 is inserted at its rear end into a bushing 21 and is axially displaceable therein for a certain distance. An annular recess 24 is located in the radially outer surface of the muzzle part 18 and locking cheeks 22 are positioned within the recess and are held in place by an annular spring 23.

Bushing 21 is telescopically displaceable into the chuck member 4 and the front end of the barrel 6 is located within the bushing. Cam 25 is located in the inside surface of the bushing 21 and extends into an axially extending slot or groove 26 and the bushing is axially displaceable relative to the barrel in the forward direction up to the bolt 27.

Diametrically opposite the groove 26, the barrel 6 has an axially extending slot 28 continuous from its front end to a position spaced from its rear end. A locking member 29 is shown in the engaged position mounted on the housing 1 and with a nose part 31 extending radially inwardly through an opening 32 in the chuck member 4 and through the axially extending slot 28 into the path of the annular shoulder 17 on the driving piston 14. When an explosive powder charge is ignited, the drive piston is driven forwardly through the bore 13 toward the nose part 31. Externally of the chuck member 4, locking member 29 is beam-shaped with its rear end 33 positioned within a recess 34 formed in the outer shell 2 of the housing 1. The front end 35 of the locking member 29, radially outwardly from the nose part 31, is overlapped by an annular retaining member 36, extending around and bearing against the outer surface of the chuck member 4. The retaining member 36 secures the locking member 29 in the engaged position as shown in FIG. 1. A leaf spring 37 is located between the outer surface of the chuck member 4 and the inner surface of the locking member 29 and biases the locking member radially outwardly.

A portion of the inside surface of the annular retaining member 36 forms a support shoulder extending in the circumferential direction and supporting the locking member 29. Support shoulder 38 has an aperture 39 extending in the circumferential direction and the circumferential dimension of the aperture is slightly greater than the corresponding dimension of the overlapped front end 35 of the locking member 29. As shown in FIG. 1, the aperture 39 is located diametrically opposite the locking member 29. By rotating the retaining member 36 from the position shown in FIG. 1, the aperture 39 can be moved into registration with the front end 35 of the locking member 29 or with the opening 32 through the chuck member 4, so that the locking member can be removed or installed.

Figure 2:
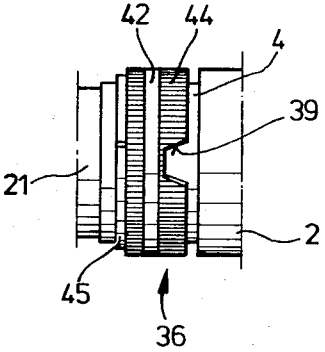
FIG. 2 is a partial elevational view of the driving device taken in the direction of the arrow II in FIG. 1.

For maintaining the overlapped position of the support shoulder 38 on the retaining member 36 with the locking member 29, a locking arrangement is provided made up of a snap-in ball 41, a spring ring 42 and a snap-in depression 43 in the outer surface of the chuck member 4 at a position ahead of the front end of the shell 2. The spring 42 biases the bal 41 into the snap-in depression 43 when they are aligned with one another. As can be seen in FIG. 2, knurling 44 is provided on the outside surface of the retaining member 36 so that the retaining member can be more easily displaced in the circumferential direction. A support ring 45 is seated in the outside surface of the chuck member 4 at the front end of the retaining member 36 for supporting the retaining member against axial displacement.

While specific embodiments of the invention have been shown and described in detail to illustrate the application of the inventive principles, it will be understood that the invention may be embodied otherwise without departing from such principles.

I claim:

1. Explosive powder charge operated device for driving fastening elements in a driving direction into a receiving material comprises a housing having a front end and a rear end with the front end-rear end direction corresponding to the driving direction of said device, an axially elongated driving member axially displaceably mounted within said housing and having a front end and a rear end spaced apart in the axial direction thereof, said driving member comprising an axially extending shank extending from the front end thereof toward the rear end and a head at the rear end thereof connected to said shank and projecting outwardly from said shank and forming an annular shoulder at the transistion from the shank to the head, a barrel within and extending axially in the front end-rear end direction of said housing, said barrel forming an axially elongated bore, said driving member being axially displaceably mounted within the bore in said barrel, a locking member displaceably mounted in said housing and having a part projecting radially inwardly into the bore in said barrel and extending substantially perpendicular to the axis of said barrel into the path of said annular shoulder of said driving member, a retaining member mounted on and extending around said housing and having a support shoulder in overlapping engagement with said locking member and holding said locking member in said housing, wherein the improvement comprising that said retaining member is displaceable on said housing in the circumferential direction around said driving member and said support shoulder extends in the circumferential direction around the axis of said driving member at least along a portion of said retaining member.

2. Explosive powder charge operated device, as set forth in claim 1, wherein said retaining member is an annular member extending around and in surface contact with said housing and said retaining member having an inner surface forming said support shoulder extending in the circumferential direction around said driving member with an aperture formed in said support shoulder and said aperture having a dimension in the circumferential direction for permitting said locking member to be displaced radially therethrough outwardly from or inwardly into said housing.

3. Explosive powder charge operated device, as set forth in claim 1, wherein a locking arrangement is provided for securing said retaining member on said housing against rotational movement thereon.

4. Explosive powder charge operated device, as set forth in claim 2, wherein a locking arrangement is provided for securing said retaining member on said housing against rotational movement thereon.

5. Explosive powder charge operated device, as set forth in claim 1, wherein spring means are located between said housing and said locking member for biasing said locking member radially outwardly away from the axis of said driving member.

* * * * *